US010330270B1

(12) United States Patent
Brannon

(10) Patent No.: US 10,330,270 B1
(45) Date of Patent: Jun. 25, 2019

(54) LIGHTED TOE KICK FOR CABINETS

(71) Applicant: Sympateco, Inc., Omaha, NE (US)

(72) Inventor: Curt Brannon, Omaha, NE (US)

(73) Assignee: Sympateco, Inc., Omaha, NE (US)

( * ) Notice: Subject to any disclaimer, the term of this patent is extended or adjusted under 35 U.S.C. 154(b) by 0 days.

(21) Appl. No.: 15/682,144

(22) Filed: Aug. 21, 2017

Related U.S. Application Data

(60) Provisional application No. 62/377,114, filed on Aug. 19, 2016.

(51) Int. Cl.

| | |
|---|---|
| ***F21S 8/00*** | (2006.01) |
| ***F21V 33/00*** | (2006.01) |
| *F21W 131/301* | (2006.01) |
| *A47B 96/00* | (2006.01) |

(52) U.S. Cl.
CPC ..... *F21S 8/03* (2013.01); *F21V 33/0012* (2013.01); *A47B 96/00* (2013.01); *F21W 2131/301* (2013.01)

(58) Field of Classification Search
CPC ..... F21S 8/037
See application file for complete search history.

(56) References Cited

U.S. PATENT DOCUMENTS

| | | | | |
|---|---|---|---|---|
| 2,887,351 | A | 5/1959 | Allender | |
| 3,729,241 | A | 4/1973 | Schippers et al. | |
| 3,779,624 | A | 12/1973 | Werderitsch | |
| 4,712,844 | A | 12/1987 | Fry | |
| 4,750,794 | A | 6/1988 | Vegh | |
| 5,255,478 | A * | 10/1993 | Baranowski | A47B 83/001 160/135 |
| 5,595,127 | A | 1/1997 | Eustace et al. | |
| 7,914,091 | B1 | 3/2011 | Joyce | |
| 8,042,890 | B2 | 10/2011 | Collins et al. | |
| 9,119,469 | B2 | 9/2015 | Seefeldt et al. | |
| 9,151,067 | B2 | 10/2015 | Hall | |
| 2003/0222547 | A1 | 12/2003 | Trees | |
| 2006/0256550 | A1* | 11/2006 | Schultz | E04F 19/026 362/147 |
| 2009/0286464 | A1 | 11/2009 | Sanchez | |
| 2011/0058353 | A1* | 3/2011 | Yang | A47F 3/001 362/84 |
| 2013/0026321 | A1 | 1/2013 | Richardson et al. | |
| 2013/0213738 | A1 | 8/2013 | Schroeder | |
| 2013/0235564 | A1* | 9/2013 | Barcelos | F21V 33/006 362/151 |

* cited by examiner

*Primary Examiner* — Evan P Dzierzynski
(74) *Attorney, Agent, or Firm* — Ryan T. Grace; Advent, LLP

(57) ABSTRACT

A lighted toe kick system includes at least one toe kick panel configured to abut against a front surface of a cabinet. The toe kick panel includes a first surface, the first surface including one or more openings, the one or more openings receiving at least one lighting component, and a generally planar second surface configured for mounting to the front surface of the cabinet. The toe kick panel also includes an upper panel cover section coupled to the toe kick panel. The upper panel cover section is configured to at least partially cover the lighting component, and further configured to direct at least a portion of the light generated via the lighting component substantially parallel to the first surface of the toe kick panel.

19 Claims, 8 Drawing Sheets

LIGHTED TOE KICK FOR CABINETS

CROSS-REFERENCE TO RELATED APPLICATIONS

The present application claims the benefit under 35 U.S.C. § 119(e) of U.S. Provisional Application Ser. No. 62/377,114, filed Aug. 19, 2016, and titled "LIGHTED TOE KICK FOR CABINETS," which is herein incorporated by reference in its entirety.

BACKGROUND

Cabinetry for kitchens and bathrooms are commonly designed to include a recessed lowermost horizontal portion (e.g., along the base of the cabinets) generally referred to as a toe kick or a toe kick recess. The toe kick allows a person's feet to extend beneath the cabinetry so the person can stand closer to the front of the countertop.

SUMMARY

Aspects of the disclosure relate to lighted toe kick systems and toe kick panels. A lighted toe kick system includes at least one toe kick panel configured to abut against a front surface of a cabinet. The toe kick panel includes a first surface, the first surface including one or more openings, the one or more openings receiving at least one lighting component, and a generally planar second surface configured for mounting to the front surface of the cabinet. The toe kick panel also includes an upper panel cover section coupled to the toe kick panel. The upper panel cover section is configured to at least partially cover the lighting component, and further configured to direct at least a portion of the light generated via the lighting component substantially parallel to the first surface of the toe kick panel.

In another embodiment, a toe kick panel includes a first surface, the first surface including one or more openings configured to receive at least one lighting component, the one or more openings generally being positioned proximate to an upper portion of the first surface; and a generally planar second surface configured for mounting to an object surface. The toe kick panel further includes at least a first panel cover section and a second panel cover section each coupled to the first surface. The first panel cover section is configured to cover at least a portion of the first surface located below the one or more openings configured to receive the lighting component(s), and the second panel cover section is configured to at least partially cover the lighting components to be received in the one or more openings. The second panel section further configured to direct at least a portion of any light generated via a given lighting component onto the first panel cover section.

In one or more embodiments, a lighted toe kick system includes a plurality of toe kick panels configured to abut against a surface of a cabinetry. Each of the plurality of toe kick panels includes a first surface including one or more openings configured to receive one or more lighting components; and a generally planar second surface configured for mounting to the surface of the cabinetry. Each of the toe kick panels further includes at least a first panel cover section and a second panel cover section each coupled to the toe kick panel(s), the first panel cover section configured to cover at least a portion of the first surface located away from the one or more openings receiving the lighting component(s), and the second panel cover section configured to at least partially cover the lighting component(s). The second panel section is further configured to direct at least a portion of any light generated via a given lighting component onto the first panel cover section. The system further includes at least one lighting component disposed within the one or more openings.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

In cabinetry, particularly in kitchens and bathrooms, it is a common practice to include a recessed lowermost horizontal portion (e.g., along the base of the cabinets) generally referred to as a toe kick or a toe kick recess. The toe kick allows for a person's feet to extend beneath the cabinetry so that the person can stand closer to the front surface of the countertop. Despite the benefit the toe kick provides, it often becomes promotes what is arguably wasted space. It can be difficult to make use of the toe kick area for anything beyond its primary purpose, as the toe kick surface undergoes far more abuse than other front surfaces or side surfaces of cabinetry due to constant contact with feet, shoes, brooms, mops, vacuums, etc.

Accordingly, the present disclosure is directed to lighted toe kick systems and toe kick panels. A lighted toe kick system includes at least one toe kick panel configured to abut against a front surface of a cabinet. The toe kick panel includes a first surface, the first surface including one or more openings, the one or more openings receiving at least one lighting component, and a generally planar second surface configured for mounting to the front surface of the cabinet. The toe kick panel also includes an upper panel cover section coupled to the toe kick panel. The upper panel cover section is configured to at least partially cover the lighting component, and further configured to direct at least a portion of the light generated via the lighting component substantially parallel to the first surface of the toe kick panel.

Example Implementations

Figure 1:
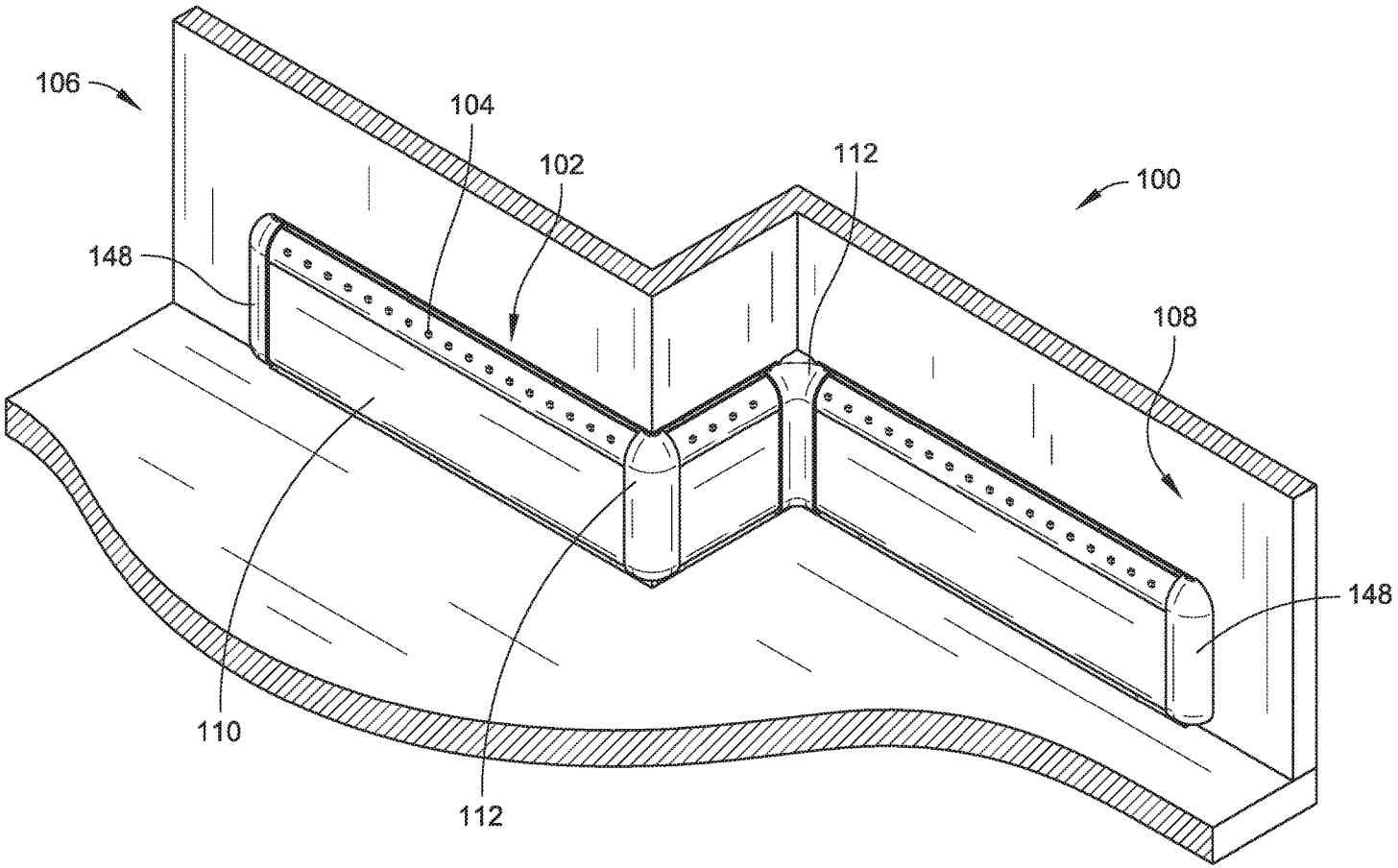
FIG. 1 is an isometric view illustrating a lighted toe kick system in accordance with an example embodiment of the present disclosure.

FIG. 1 illustrates a lighted toe kick system 100 in accordance with an example embodiment of the present disclosure. As shown, a lighted toe kick system 100 includes one or more toe kick panels 102 that can be coupled to one or more lighting components 104. The toe kick panel 102 is configured to abut against a surface of a cabinet 106 (e.g., a kitchen or bathroom type cabinet). For example, the toe kick panel 102 can abut against a front surface 108 of the cabinet 106. The toe kick panels 102 can be horizontally aligned along the front surface 108 of the cabinets 106 to cover the lowermost portion of the front surface 108 (e.g., along the toe kick recess). In embodiments, system 100 can further include one or more panel covers (e.g., cover plate 110) configured to cover portion(s) of the toe kick panels 102. The system 100 can also include one or more corner pieces 112 configured to connect neighboring toe kick panels 102, and/or one or more end pieces 148 configured to cover the edge(s) of the outermost toe kick panels 102. While the lighted toe kick system 100 is shown with respect to cabinetry, it is to be understood that the system could be utilized on the front surfaces of other objects, such as shelves, baseboards, appliances, and so forth.

Figure 2:
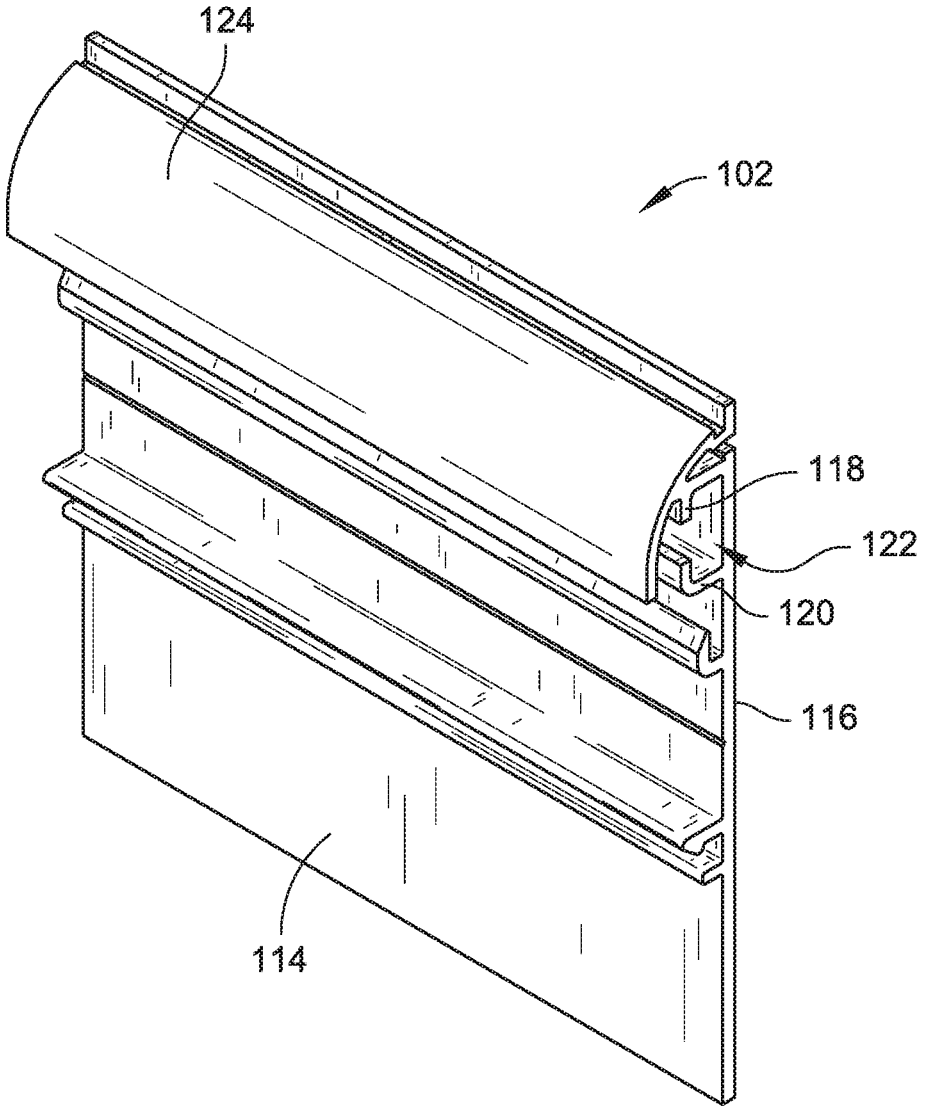
FIG. 2 is an isometric view illustrating a lighted toe kick panel of a lighted toe kick system, such as the lighted toe kick system shown in FIG. 1, in accordance with an example embodiment of the present disclosure.
Figure 3A:
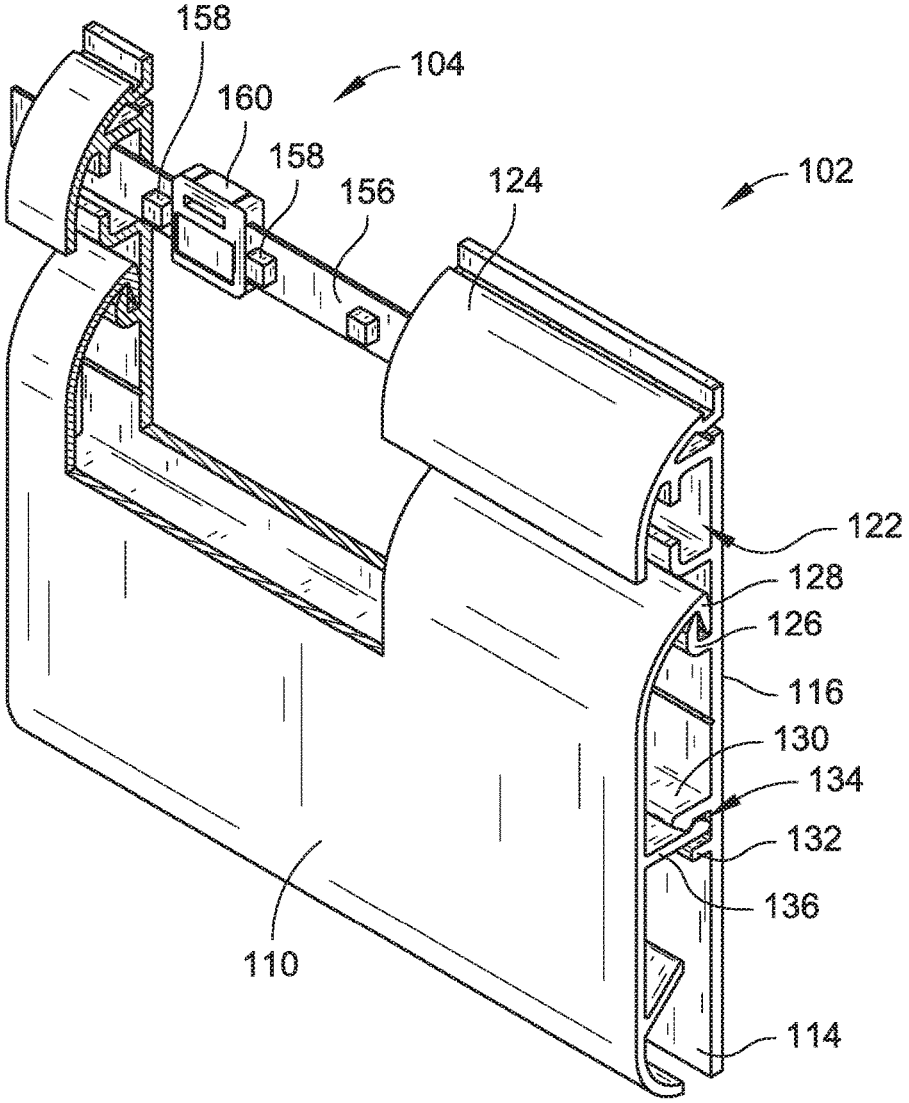
FIG. 3A is a cutaway isometric view illustrating a lighted toe kick system in accordance with an example embodiment of the present disclosure.
Figure 3B:
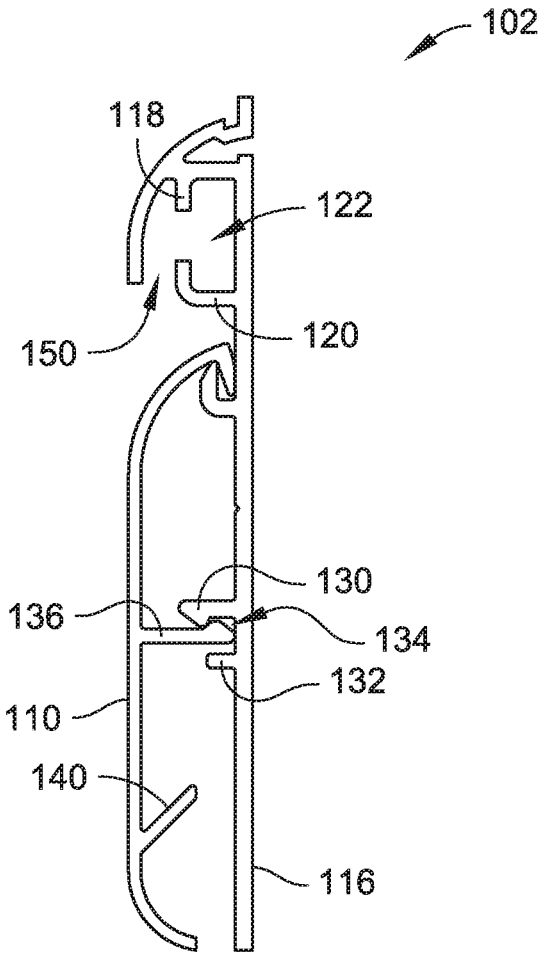
FIG. 3B is a right side elevation view illustrating a lighted toe kick system in accordance with an example embodiment of the present disclosure.
Figure 4:
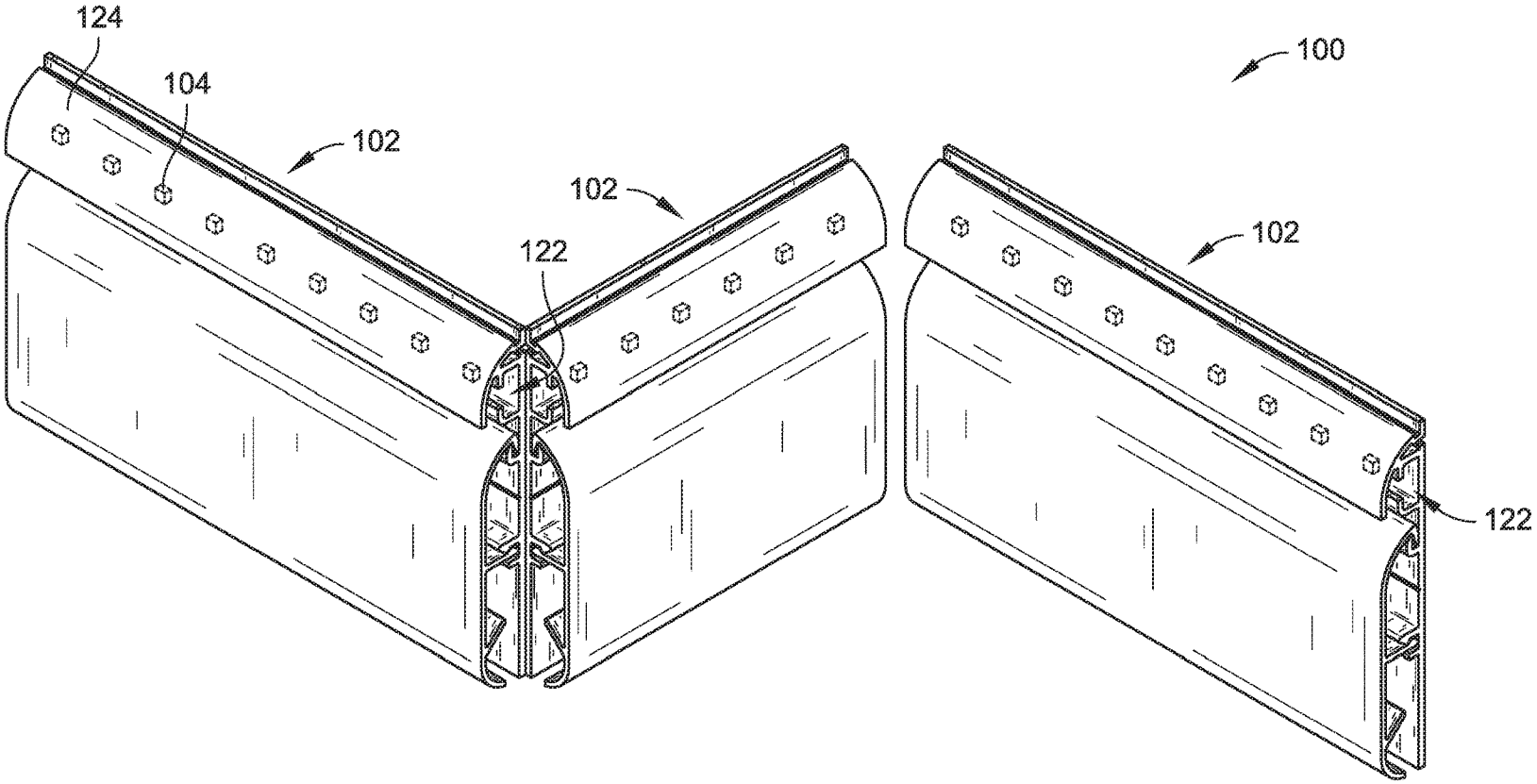
FIG. 4 is an isometric view illustrating a lighted toe kick system in accordance with an example embodiment of the present disclosure.
Figure 5:
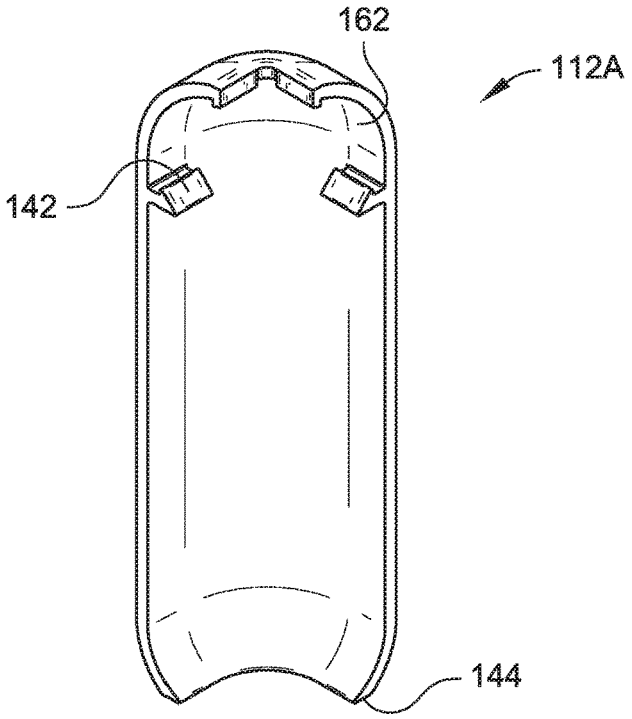
FIG. 5 is an isometric view illustrating an inward corner piece of a lighted toe kick system, such as the lighted toe kick system illustrated in FIG. 1, in accordance with an example embodiment of the present disclosure.
Figure 6:
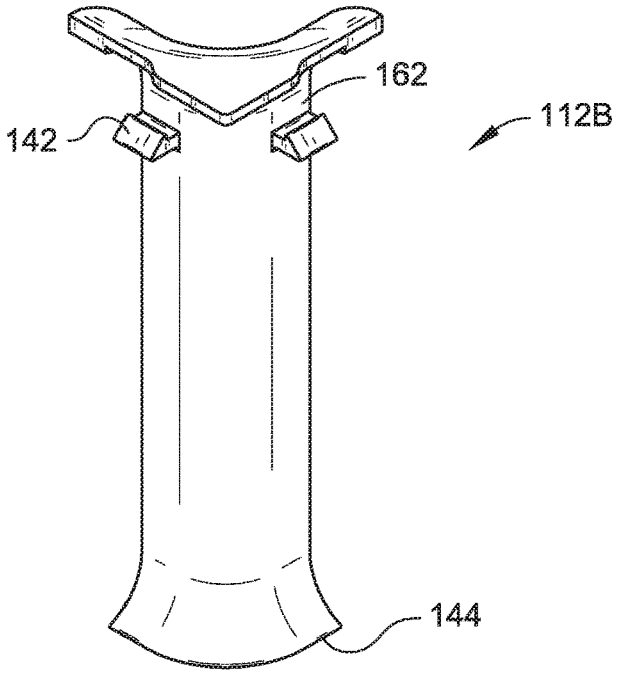
FIG. 6 is an isometric view illustrating an outward corner piece of a lighted toe kick system, such as the lighted toe kick system illustrated in FIG. 1, in accordance with an example embodiment of the present disclosure.

FIGS. 2 through 4 further illustrate the toe kick panel 102. The toe kick panel 102 includes a first surface 114, and a generally planar second surface 116 configured for abutting against a surface (e.g., front surface 108) of the cabinet 106. The toe kick panel 102 can be formed from a variety of materials including, but not necessarily limited to: wood, wood composite, metal, rubber, synthetic rubber, plastic, tile, vinyl, and so forth. The type and color of the material can be selected based on several factors such as durability, resilience, appearance (e.g., similar to the finish of the cabinet 106 surfaces), ease of cleaning, comfort (e.g., for feet that come in contact with the toe kick panel 102), and so forth. The toe kick panel 102 can be secured to the cabinet 106 using, for example, one or more fasteners such as one or more mechanical fasteners (e.g., screws, nails, rivets, clamps, mechanical retention devices, and so forth). The fasteners can be mounted through formed (e.g., cut, drilled, etc.) holes in the toe kick plate 102. The fastener can also comprise an adhesive (e.g., used alone or in combination with one or more mechanical fasteners) such as two-sided adhesive tape, glue, caulk, cement, or other similar bonding agents. The toe kick panel 102 can be formed in various lengths. For example, the length of the toe kick panel 102 can be selected to fit the length of the toe kick recess or a portion thereof.

In embodiments, the toe kick panel 102 includes one or more openings configured to receive the lighting component 104. For example, the first surface 114 of the toe kick panel 102 can include a first protrusion 118 and an opposing second protrusion 120, as illustrated in FIG. 2. The first and second protrusions 118, 120 can extend vertically across the toe kick panel 102, forming a slot or channel (e.g., slot 122) for receiving the lighting component 104 and associated wiring. In some embodiments, the one or more openings generally can be positioned proximate to an upper portion of the first surface 114 of the toe kick panel 102 (e.g., at a position less likely to be kicked and/or better apt to distribute light over the toe kick system 100). However, this configuration is offered by way of example only and is not meant to be restrictive of the present disclosure. In other embodiments, other configurations of openings can be formed on the first surface 114 and/or the second surface 118 such as horizontally extending protrusions, vertically extending protrusions, cut and/or drilled openings, combinations thereof, and so forth. For example, the toe kick panel 102 can include a one or more openings passing through the first and second surfaces 114, 118 configured for receiving a lighting component affixed to the cabinets 108 and/or associated wiring.

In embodiments, the lighting component 104 can comprise any type of lighting such as light emitting diodes 158 (LEDs), individually addressable LEDs, collectively addressable LEDs, incandescent bulbs, rope LEDs, rope incandescent lighting, individually addressable LED strips (e.g., digital LED strips), collectively addressable LED strips (e.g., analog LED strips), strip incandescent lighting, motion-sensitive lighting, sound-reactive lighting, and so forth. In a specific embodiment, the lightening component 104 includes an LED strip (e.g., as described with reference to FIG. 3A). For example, the lighting component 104 can include flexible circuitry 156 populated with a plurality of LEDs 158. The flexible circuitry 156 can enable the plurality of LEDs 158 to be individually and/or collectively addressable. In embodiments, the LED strip can include one or more clips 160 for coupling with the toe kick panel 102. For example, the slot 122 can be configured to retain the clip 160. The LED strip can be cut to a selected length to fit the toe kick recess or a portion thereof. In embodiments, the system can include a plurality of toe kick panels 102 that can be aligned to allow an LED strip to pass through slot 122 on each of the adjacent panels 102 (e.g., as described with reference to FIG. 1).

In embodiments, the lighting component 104 can be coupled with a power supply (e.g., battery, electrical power supply, etc.). In some embodiments, the lighting component 104 can be hardwired directly to the electrical power supply of a building and controlled, for example, by a wall switch or dimmer. In other embodiments, the lighting component 104 can be coupled to a controller configured to operate the lighting component 104. The controller can be integral to and/or separate from the toe kick panel 102, and can be electrically or communicatively coupled with the lighting component 104. The controller can be programmed or otherwise configured for activating and/or adjusting the lighting component 104. For example, the controller can include or be coupled with one or more drivers, timers, dimmers (e.g., pulse width modulation (PWM) controller), power transmitters, and so forth. In a specific embodiment, the controller can be configured to adjust the color temperature (e.g., cool, warm, etc.) and/or change the color of the lighting component 104. For example, the controller can include a dimmer configured to adjust the lighting component to a selected degrees Kelvin (K). In some embodiments, the controller can be configured to activate automatically the lighting component 104. The controller can be electrically or communicatively coupled with a sensor (e.g., motion and/or optical sensor, mechanical sensor, etc.) configured to detect motion in proximity to the toe kick recess, and activate the lighting component 104 based on detection of that motion. For example, the controller can be configured to activate the lighting component when the toe kick late 102 and/or plate cover 110 is touched or "kicked" based on date received from the sensor. In such embodiments, the sensor may be integral to the toe kick plate 102, the lighting component 104, and/or the controller. In some embodiments, the controller can be programmed to activate or deactivate the lightening component 104 based on a selected time interval. For example, the controller can include a timer configured to deactivate the lighting component 104 after the lighting component 104 has been activated for a selected time interval.

In some embodiments, a lip 124 is configured to extend over the slot 122 (e.g., as described with reference to FIG. 2). The lip 124 can provide protection for the lighting component 104 disposed within the slot 122, e.g., by at least partially covering the lighting component 104. The lip 124 may be integrally formed with the toe kick panel 102, or it may be a separate portion attachable to the toe kick panel 102, e.g., by a slide-fit or snap-fit connection (e.g., broadly, the lip 124 can be coupled to the toe kick panel 102). In some embodiments, the lip 124 is configured (e.g., curved downwardly from an upper edge of the toe kick panel 102 and terminating with an edge generally parallel to the toe kick panel 102) to direct light across the toe kick panel system 100. In some embodiments, the lip 124 is configured to limit an amount of light that can project outwardly away from the toe kick panel system 100 (e.g., by being translucent, opaque, or reflective). It is to be understood that the lip 124, in some embodiments, can also be configured to permit a substantial amount of light to project outwardly from the toe kick panel system 100 (e.g., by being transparent).

In some embodiments, the toe kick panel 102 is configured to receive a cover plate (e.g., first panel cover section) 110, as illustrated in FIGS. 3A and 3B. The cover plate 110 may be integrally formed with the toe kick panel 102, or it may be a separate portion attachable to the toe kick panel 102, e.g., by a slide-fit or snap-fit connection (e.g., broadly, the cover plate 110 can be coupled to the toe kick panel 102). For example, the toe kick panel 102 can include one or more openings configured to receive corresponding protrusions on the cover plate 110. The openings can be formed by one or more outwardly extending protrusions disposed on the first surface 114. In an exemplary embodiment, the first surface 114 includes a third protrusion 126 that extends horizontally across the panel 102 forming a lip. The lip can receive a corresponding flange 128 disposed on the cover plate 110. The first surface 114 can further include a fourth protrusion 130 and an opposing fifth protrusion 132. The fourth and fifth protrusions 130, 132 extend horizontally across the toe kick panel 102, forming a second slot 134. The second slot 134 can receive a corresponding protrusion 136 disposed on the cover plate 110. However, this configuration of openings and protrusions is offered by way of example only and is not meant to restrict the present disclosure. In other embodiments, any type and/or number of slots, openings, protrusions, and so forth can be utilized to form an interface between the toe kick panel 102 and the cover plate 110.

The cover plate 110 can be formed from a variety of materials including, but not necessarily limited to: wood, wood composite, metal, rubber, synthetic rubber, plastic, tile, vinyl, and so forth. The type and color of the material can be selected based on several factors such as durability, resilience, appearance (e.g., similar to the finish of the cabinet 106 surfaces and/or the toe kick plate 102), ease of cleaning, comfort (e.g., for feet that come in contact with the system 100), and so forth.

In some embodiments, the cover plate 110 and the lip 124 can be considered to be, respectively, a first or lower panel cover section 110 and a second or upper panel cover section 124. The first cover panel section 110 can be configured to be more resilient (e.g., less stiff) than the second cover panel section 110. By being more resilient, it can be more forgiving upon being contacted (e.g., being kicked or otherwise bumped), making it more durable (e.g., dent-resistant) and/or user-friendly (e.g., less likely to be painful if kicked or bumped). The resilience may be achieved through material choice (e.g., rubber, polyurethane, soft wood, etc.) and/or construction (e.g., cantilevered support to promote flexing (e.g., of bottom portion, per FIGS. 3A and 3B); thinner material; etc.). For example, the connection between the lip and flange 128 can provide a fulcrum to promote flexing of the bottom portion of the cover plate 110. In some embodiments, at least a portion of the first cover panel section 110 (e.g., a cantilevered portion) is configured to elastically deflect at least one millimeter (mm) and may be able to deflect, e.g., at least 2-3 mm, e.g., under light to moderate manual force (e.g., 1-20 newtons (N) force or, more particularly, 5-15 N), without breaking the first panel cover section 110 and/or inducing plastic (e.g., permanent) deformation (e.g., the deflection is within the elastic deformation range thereof).

Meanwhile, as set forth above, the second panel cover section 124 can be positioned away from (e.g., generally laterally above) the first panel cover section 110 and can be designed and configured to protect the lighting component 104. Accordingly, in some embodiments, the second panel cover section 124 can be stiffer and/or stronger than the first panel cover section 110 (e.g., able to resist deflection into the lighting component 104 and/or resist breakage or cracking of the section itself, even if accidentally kicked and/or bumped). The second panel cover section 124 may be made stiffer, for example, through material choice (e.g., plastic, metal, etc.) and/or construction (e.g., internal ribbing within the second panel cover section 124, additional supports (not shown, etc.) relative to the toe kick panel 102, thicker material, etc.). Depending on the chosen material and structural design, it may be possible, in some embodiments, for the first panel cover section 110 and the second panel cover section 124 to be integrally formed (not shown), so long as the general construction requirements for each section can be met.

Further, the second panel cover section 124 is configured to permit light generated via the lighting component 104 to be directed onto a desired surface and/or toward a general area. For example, the second cover panel section 124 can be configured to project and/or deflect light downwardly across the first panel cover section 110 and/or parallel to a lower portion of the toe kick plate 102. The lighting direction may be achieved, for example, by purposefully leaving a lighting gap 150 between the second panel cover section 124 and the toe kick plate 102 (e.g., as described with reference to FIG. 3B) and/or by the construction of the second panel cover section 124 (e.g., as a light shield and/or deflector). Where a lighting gap 150 is employed, the second panel cover section 124 may be configured to help direct light toward the lighting gap 150. In some embodiments, the second panel cover section 124 may be reflective and/or opaque in order to limit the escape of light except through the lighting gap 150. In some embodiments, the second panel cover section 124 may be formed of a translucent material so that some amount of the light may pass directly therethrough (e.g., to facilitate "soft" lighting proximate to upper section of the toe kick plate 102). In other embodiments, the second cover panel section 124 may be formed of a transparent material so that a substantial amount of light may pass directly therethrough (e.g., to facilitate a "bright" lighting proximate to the upper section of the toe kick plate 102). It is to be understood that any such lighting features may be used, whether alone or in combination, to achieve the desired lighting effects.

In some embodiments, the first panel cover section 110 and the second panel cover section 124 can be configured relative to one another to promote lighting across the toe kick plate system 100. For example, the depth of the lighting gap 150 may be greater than a depth associated with the first panel cover section 110 to facilitate lighting across the first panel cover section 110. That is, the first panel cover section 110 can be sized and configured to minimize blocking light projected downwardly from the one or more lighting components 104 and the related second panel cover section 124. Further, the upper portion of the first panel cover section 110 (e.g., the portion thereof closest to the lighting components 104) may be downwardly curved, in part, so as to minimize blocking any light projected from the one or more lighting components 104 and/or to redirect (e.g., reflect) a portion of the light to a region proximate the first panel cover section 110 (e.g., substantially parallel to the first panel cover section 110 and/or the first surface 114 of the toe kick panel 102).

In implementations, the system 100 can include a plurality of toe kick panels 102 that can be aligned horizontally along a surface of the cabinetry. For example, the toe kick panels 102 can be aligned along the lowermost portion of the cabinetry (e.g., as described with reference to FIG. 1). The aligned panels form a generally continuous slot or channel for running the lighting component(s) 104 and/or associated wiring horizontally along the cabinetry surface and between adjacent toe kick panels 102, as described above.

In some embodiments, the system 100 can further include one or more corner pieces 112, as illustrated in FIGS. 1, 5, 6, and 8. The corner pieces are 112 configured to connect neighboring toe kick panels 102. For example, the corner pieces 112 can be used to fit the exposed corners of the cabinet 106 (e.g., cover exposed corner portions), cover up exposed end portions or excess end lengths of the toe kick panels 102, and/or cover up gaps between toe kick panels 102. The corner pieces 112 can be configured to fit either outwardly protruding corner areas (e.g., outwardly corner piece 112A, as described with reference to FIG. 5) or inwardly protruding corner areas (e.g., inward corner piece 112B, as described with reference to FIG. 6). The corner pieces 112 can overlap the edges of the toe kick panels 102 and/or the cover plates 110. The corner pieces 112 can be formed from a variety of materials including, but not necessarily limited to: wood, wood composite, metal, rubber, synthetic rubber, plastic, tile, vinyl, and so forth. The type and color of material can be selected for durability and/or appearance. For example, a material and/or can be selected that is similar in appearance to the toe kick panel 102 and/or the cover plate 110 to create a uniform aesthetic appearance. In some embodiments, the upper and lower portions of the corner pieces 112 can be formed in a curved shape to fit over (e.g., overlap) the lip 124 and the cover plate 110, respectively.

The corner pieces 112 can be secured to the toe kick panels 102, the cover plates 110, and or the cabinet 106 in a variety of ways. The corner piece 112 may be integrally formed with the toe kick panel 102, or it may be a separate portion attachable to the toe kick panel 102, for example, by a slide-fit or snap-fit connection (e.g., broadly, the corner piece 112 can be coupled to the toe kick panel 102). In some embodiments, the corner pieces 112 can include one or more protrusions 142 and/or lips 144 configured to interface with the first surface 114 of the toe kick panel 102. For example, the corner piece 112 can include a protrusion 142 configured to engage lip 124 (e.g., a slide-fit or snap-fit connection; as described with reference to FIG. 8). The corner pieces 112 can also be secured using, for example, one or more fasteners such as mechanical fasteners (e.g., screws, nails, rivets, clamps, mechanical retention devices, and so forth). The fasteners can be mounted through formed (e.g., cut, drilled, etc.) holes in the corner piece 112. The fastener can also comprise an adhesive (e.g., used alone or in combination with one or more mechanical fasteners) such as two-sided adhesive tape, glue, caulk, cement, or other similar bonding agents. The protrusion 142 can also form a slot 162 that can retain the lighting component 104 and allow a substantially continuous lighting component (e.g., LED strip; LED rope) to pass between adjacent toe kick panels 102.

Figure 7A:
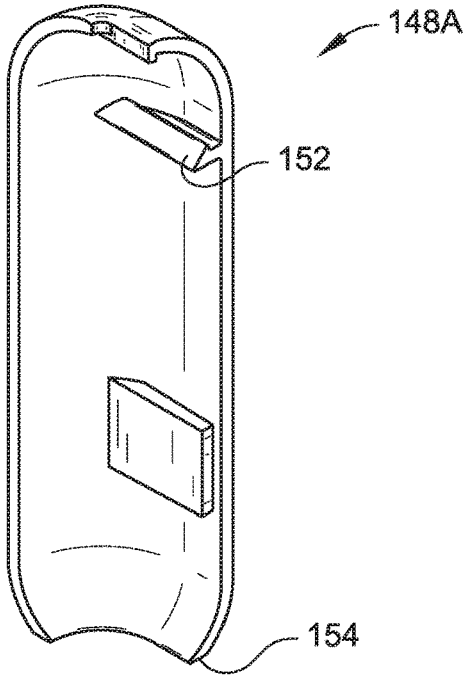
FIG. 7A is an isometric view illustrating an end piece of a lighted toe kick system, such as the lighted toe kick system illustrated in FIG. 1, in accordance with an example embodiment of the present disclosure.
Figure 7B:
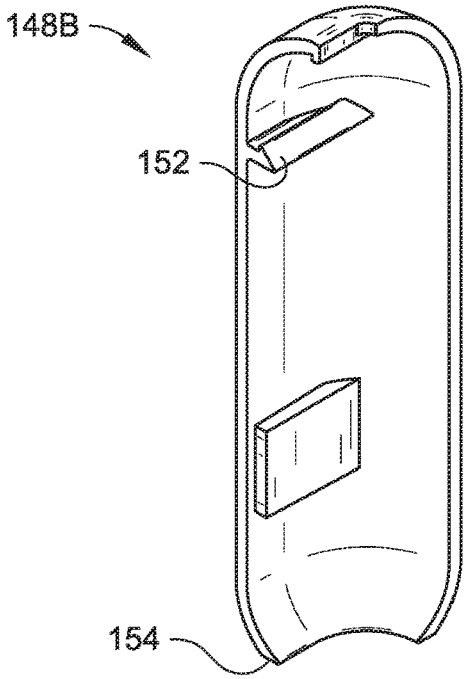
FIG. 7B is another isometric view illustrating an end piece of a lighted toe kick system, such as the lighted toe kick system illustrated in FIG. 1, in accordance with an example embodiment of the present disclosure.

In some embodiments, the system 100 can further include one or more end pieces 148, as illustrated in FIGS. 7A and 7B. The end pieces are 148 configured to cover at least a portion of an end toe kick panel 102. For example, the end pieces 148 can be used to cover end sections of the toe kick recess of cabinet 106 (e.g., area where the cabinet 106 abuts wall), and/or cover up exposed end portions or excess end lengths of the toe kick panels 102 (e.g., cover the outermost edges of the toe kick panels 102, as described with reference to FIG. 1). The end pieces 148 can be configured as a right end piece 148A (e.g., as described with reference to FIG. 7A) to fit right end areas, or as an opposite left end piece 148B (e.g., as described with reference to FIG. 7B) to fit left end areas. The end pieces 148 can overlap the edges of the toe kick panels 102 and/or the cover plates 110. The end pieces 148 can be formed from a variety of materials including, but not necessarily limited to: wood, wood composite, metal, rubber, synthetic rubber, plastic, tile, vinyl, and so forth. The type and color of material can be selected for durability and/or appearance. For example, a material and/or can be selected that is similar in appearance to the toe kick panel 102 and/or the cover plate 110 to create a uniform aesthetic appearance. In some embodiments, the upper and lower portions of the end pieces 148 can be formed in a curved shape to fit over (e.g., overlap) the lip 124 and the cover plate 110, respectively.

The end pieces 148 can be secured to the toe kick panels 102, the cover plates 110, and or the cabinet 106 in a variety of ways. The end piece 148 may be integrally formed with the toe kick panel 102, or it may be a separate portion attachable to the toe kick panel 102, for example, by a slide-fit or snap-fit connection (e.g., broadly, the end piece 148 can be coupled to the toe kick panel 102). In some embodiments, the end pieces 148 can include one or more protrusions 152 and/or lips 154 configured to interface with the first surface 114 of the toe kick panel 102. For example, the end piece 148 can include a protrusion 152 configured to engage lip 124 (e.g., a slide-fit or snap-fit connection; as described with reference to FIG. 1). The end pieces 148 can also be secured using, for example, one or more fasteners such as mechanical fasteners (e.g., screws, nails, rivets, clamps, mechanical retention devices, and so forth). The fasteners can be mounted through formed (e.g., cut, drilled, etc.) holes in the end piece 148. The fastener can also comprise an adhesive (e.g., used alone or in combination with one or more mechanical fasteners) such as two-sided adhesive tape, glue, caulk, cement, or other similar bonding agents. The protrusion 152 can also form a slot 164 that can retain the lighting component 104.

Figure 8:
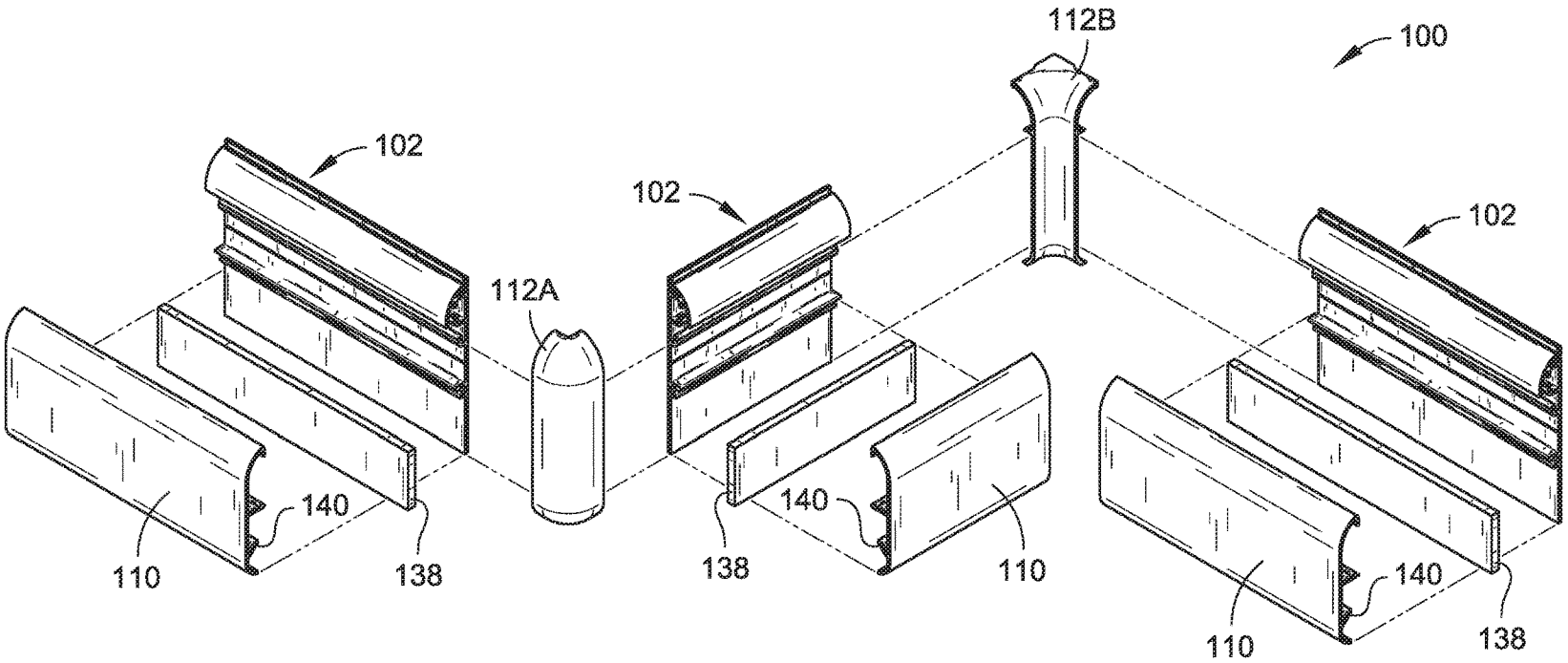
FIG. 8 is a partial exploded view illustrating a lighted toe kick system, such as the lighted toe kick system illustrated in FIG. 1, including a padding layer in accordance with an example embodiment of the present disclosure.

In some embodiments, the system 100 can include a padding layer 138 disposed between the toe kick panel 102 and the cover plate 110, as illustrated in FIG. 8. The padding layer 138 can be formed from one or more cushioning and/or insulating materials including, but not necessarily limited to: foam, rubber, synthetic rubber, glasswool, polyester, and so forth. The padding layer 138 can provide cushioning (e.g., for feet that come in contact with the system 100), resiliency, and/or protection for the underlying toe kick panel 102 or cabinet 106 (e.g., from contact with feet, shoes, brooms, mops, vacuums, etc.). In embodiments, the cover plate 110 can include one or more protrusions 140 configured to bias the cover plate 110 with respect to the padding layer 138 (e.g., as described with reference to FIGS. 3A and 3B).

The system 100, including some or all of its components, can operate under computer control. For example, the lighting component 104 can be coupled with one or more controllers, as described above. In embodiments, a controller can include a processor, a memory, and a communications interface. The processor provides processing functionality for at least the controller and can include any number of processors, micro-controllers, circuitry, field programmable gate array (FPGA) or other processing systems, and resident or external memory for storing data, executable code, and other information accessed or generated by the controller. The processor can execute one or more software programs embodied in a non-transitory computer readable medium that implement techniques described herein. The processor is not limited by the materials from which it is formed or the processing mechanisms employed therein and, as such, can be implemented via semiconductor(s) and/or transistors (e.g., using electronic integrated circuit (IC) components), and so forth.

The memory can be an example of tangible, computer-readable storage medium that provides storage functionality to store various data and or program code associated with operation of the controller, such as software programs and/or code segments, or other data to instruct the processor, and possibly other components of the system 100, to perform the functionality described herein. Thus, the memory can store data, such as a program of instructions for operating the system 100 (including its components), and so forth. It should be noted that while a single memory is described, a wide variety of types and combinations of memory (e.g., tangible, non-transitory memory) can be employed. The memory can be integral with the processor, can comprise stand-alone memory, or can be a combination of both.

Some examples of the memory can include removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, remove (e.g., server and/or cloud) memory, and so forth. In implementations, memory can include removable integrated circuit card (ICC) memory, such as memory provided by a subscriber identity module (SIM) card, a universal subscriber identity module (USIM) card, a universal integrated circuit card (UICC), and so on.

Generally, any of the functions described herein can be implemented using hardware (e.g., fixed logic circuitry such as integrated circuits), software, firmware, manual processing, or a combination thereof. In the instance of a hardware configuration, the various systems discussed herein may be implemented as integrated circuits along with other functionality. Such integrated circuits may include all of the functions of a system or circuit, or a portion of the functions of the system or circuit. Further, elements of the systems or circuits may be implemented across multiple integrated circuits. Such integrated circuits may comprise various integrated circuits, including, but not necessarily limited to: a monolithic integrated circuit, a flip chip integrated circuit, a multichip module integrated circuit, and/or a mixed signal integrated circuit. In the instance of a software implementation, the various blocks discussed herein represent executable instructions (e.g., program code) that perform specified tasks when executed on a processor. These executable instructions can be stored in one or more tangible computer readable media. In some implementations, the entire system or circuit may be implemented using its software or firmware equivalent. In other implementations, one part of a given system or circuit may be implemented in software or firmware, while other parts are implemented in hardware.

The communications interface and/or the processor can be configured to communicate with a variety of different networks, such as a wide-area cellular telephone network, such as a cellular network, a 3G cellular network, a 4G cellular network, or a global system for mobile communications (GSM) network; a wireless computer communications network, such as a WiFi network (e.g., a wireless local area network (WLAN) operated using IEEE 802.11 network standards); an ad-hoc wireless network, an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface can be configured to communicate with a single network or multiple networks across different access points. In a specific embodiment, a communications interface can transmit information from the controller to an external device (e.g., a cell phone, a computer connected to a WiFi network, cloud storage, etc.). In another specific embodiment, a communications interface can receive information from an external device (e.g., a cell phone, a computer connected to a WiFi network, cloud storage, etc.).

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A lighted toe kick system comprising:

at least one toe kick panel configured to abut against a front surface of a cabinet, the toe kick panel including:

a first surface, the first surface including one or more openings, the one or more openings receiving at least one lighting component, the one or more openings comprising a slot formed by a first protrusion and an opposing second protrusion disposed on the first surface;

a generally planar second surface configured for mounting to the front surface of the cabinet; and an upper panel cover section coupled to the at least one toe kick panel, the upper panel cover section configured to at least partially cover the at least one lighting component, the upper panel cover section further configured to direct at least a portion of the light generated via the at least one lighting component substantially parallel to the first surface of the toe kick panel.

2. The lighted toe kick system as recited in claim 1, wherein the at least one lighting component comprises at least one of an LED or an incandescent bulb.

3. The lighted toe kick system as recited in claim 1, further comprising at least one corner piece, the at least one corner piece configured to cover at least one of a corner portion of the cabinet, an exposed edge portion of the at least one toe kick panel, or an exposed edge portion of the at least one upper panel cover section.

4. The lighted toe kick system as recited in claim 1, further comprising at least one lower panel cover section coupled to the first surface, a respective lower panel cover section located below a corresponding upper panel cover section.

5. The lighted toe kick system as recited in claim 4, wherein the first surface includes one or more slots configured to receive one or more corresponding protrusions disposed on the at least one lower panel cover section.

6. The lighted toe kick system as recited in claim 4, further comprising a padding layer disposed between the at least one toe kick panel and the at least one lower panel cover section.

7. The lighted toe kick system as recited in claim 4, wherein the upper panel cover section is configured to be stiffer than the lower panel cover section.

8. The lighted toe kick system as recited in claim 4, wherein at least a portion of the lower panel cover section is configured to elastically deflect at least one millimeter under a force of 15 newtons or less.

9. The lighted toe kick system as recited in claim 1, wherein the upper panel cover section comprises a downwardly curved lip.

10. A toe kick panel comprising:

a first surface, the first surface including one or more openings configured to receive at least one lighting component, the one or more openings generally being positioned proximate to an upper portion of the first surface, the one or more openings comprising a slot formed by a first protrusion and an opposing second protrusion disposed on the first surface;

a generally planar second surface configured for mounting to an object surface; and at least a first panel cover section and a second panel cover section each coupled to the first surface, the first panel cover section configured to cover at least a portion of the first surface located below the one or more openings configured to receive the at least one lighting component, the second panel cover section configured to at least partially cover the at least one lighting component to be received in the one or more openings, the second panel section further configured to direct at least a portion of any light generated via a given lighting component onto the first panel cover section.

11. The toe kick panel as recited in claim 10, wherein the at least one lighting component is received in the one or more openings, the at least one lighting component comprising at least one of an LED or an incandescent bulb.

12. The toe kick panel as recited in claim 10, wherein the second panel cover section defines a lip configured to cover at least a portion of the one or more openings.

13. The toe kick panel as recited in claim 10, wherein the object surface comprises a front surface of a cabinet.

14. The toe kick panel as recited in claim 10, wherein at least a portion of the first panel cover section is configured to elastically deflect at least one millimeter under a force of 15 newtons or less.

15. A lighted toe kick system comprising:

a plurality of toe kick panels configured to abut against a surface of a cabinetry, each of the plurality of toe kick panels including:

a first surface, the first surface including one or more openings configured to receive one or more lighting components, the one or more openings comprising a slot formed by a first protrusion and an opposing second protrusion disposed on the first surface; and a generally planar second surface configured for mounting to the surface of the cabinetry; and at least a first panel cover section and a second panel cover section each coupled to at least one toe kick panel of the plurality of toe kick panels, the first panel cover section configured to cover at least a portion of the first surface located away from the one or more openings receiving the at least one lighting component, the second panel cover section configured to at least partially cover the at least one lighting component, the second panel section further configured to direct at least a portion of any light generated via a given lighting component onto the first panel cover section; and at least one lighting component disposed within the one or more openings.

16. The lighted toe kick system as recited in claim 15, wherein each of the plurality of toe kick panels are configured to align horizontally along a lowermost front surface of the cabinetry.

17. The lighted toe kick system as recited in claim 15, further comprising at least one corner piece, the at least one corner piece configured to cover at least one of a corner portion of the cabinetry or an exposed edge portion of at least one toe kick panel of said plurality of toe kick panels.

18. A lighted toe kick system comprising:

at least one toe kick panel configured to abut against a front surface of a cabinet, the toe kick panel including:

a first surface, the first surface including one or more openings, the one or more openings receiving at least one lighting component;

a generally planar second surface configured for mounting to the front surface of the cabinet;

an upper panel cover section coupled to the at least one toe kick panel, the upper panel cover section configured to at least partially cover the at least one lighting component, the upper panel cover section further configured to direct at least a portion of the light generated via the at least one lighting component substantially parallel to the first surface of the toe kick panel; and at least one lower panel cover section coupled to the first surface, a respective lower panel cover section located below a corresponding upper panel cover section, the first surface including one or more slots configured to receive one or more corresponding protrusions disposed on the at least one lower panel cover section.

19. A lighted toe kick system comprising:

at least one toe kick panel configured to abut against a front surface of a cabinet, the toe kick panel including:

a first surface, the first surface including one or more openings, the one or more openings receiving at least one lighting component;

a generally planar second surface configured for mounting to the front surface of the cabinet;

an upper panel cover section coupled to the at least one toe kick panel, the upper panel cover section configured to at least partially cover the at least one lighting component, the upper panel cover section further configured to direct at least a portion of the light generated via the at least one lighting component substantially parallel to the first surface of the toe kick panel;

at least one lower panel cover section coupled to the first surface, a respective lower panel cover section located below a corresponding upper panel cover section; and a padding layer disposed between the at least one toe kick panel and the at least one lower panel cover section.

* * * * *